US006007195A

United States Patent [19]

Kokubo

[11] Patent Number: 6,007,195

[45] Date of Patent: Dec. 28, 1999

[54] SCANNER PRINTER CONNECTABLE TO A PCMCIA CARD SLOT OF AN EXTERNAL COMPUTER AND METHOD FOR CONNECTING A SCANNING PRINTER TO A PCMCIA CARD SLOT OF AN EXTERNAL COMPUTER

[75] Inventor: Masatoshi Kokubo, Aichi-ken, Japan

[73] Assignee: Brother Kogyo Kabushiki Kaisha, Nagoya, Japan

[21] Appl. No.: 08/908,965

[22] Filed: Aug. 8, 1997

[30] Foreign Application Priority Data

Aug. 20, 1996 [JP] Japan ..... 8-218389

[51] Int. Cl.[6] ..... B41J 29/13

[52] U.S. Cl. ..... 347/108

[58] Field of Search ..... 347/108, 109; 395/275, 325, 425, 750; 400/88

[56] References Cited

U.S. PATENT DOCUMENTS

| | | | |
|---|---|---|---|
| 5,020,926 | 6/1991 | Wilhelm | 347/108 |
| 5,593,236 | 1/1997 | Bobry | 347/109 |
| 5,634,730 | 6/1997 | Bobry | 400/88 |
| 5,650,820 | 7/1997 | Sekine et al. | 347/109 |

FOREIGN PATENT DOCUMENTS 48-17630 3/1973 Japan .

*Primary Examiner*—N. Le
*Assistant Examiner*—Thien Tran
*Attorney, Agent, or Firm*—Oliff & Berridge, PLC

[57] ABSTRACT

A scanning printer is connected to a computer by inserting the scanning printer into the card slot of the computer and both print data and power are supplied to the scanning printer. In printing, the scanning printer is extracted from the card slot and prints when an operator holds the scanning printer on recording paper and presses a printing button to start printing.

18 Claims, 4 Drawing Sheets

SCANNER PRINTER CONNECTABLE TO A PCMCIA CARD SLOT OF AN EXTERNAL COMPUTER AND METHOD FOR CONNECTING A SCANNING PRINTER TO A PCMCIA CARD SLOT OF AN EXTERNAL COMPUTER

BACKGROUND OF THE INVENTION

1. Field of the Invention

This invention relates to a scanning printer for printing by scanning on a recorded medium manually, automatically or semi-automatically, and more particularly relates to a scanning printer attachable to and detachable from, as a portable printer, a small-sized and portable external computer.

2. Description of Related Art

Heretofore, a scanning printer connected to an external computer was built in a housing different from the external computer housing and received print data via a cable, for example. A scanning printer that prints while it is scanned manually is proposed in JP-A-48-17630. Because this type of printer prints on recording paper manually, the travel speed is not fixed. Therefore, a displacement detector for detecting relative positional change between a print head and a recorded medium is provided. The change of a relative position caused by the displacement detector moving on the recorded medium is detected and the position of the print head is detected. That is, a roller moved together with the print head touches the recorded medium and is rotated. The change of the relative position between the print head and the recorded medium is detected by detecting the turning angle of the roller.

Because the displacement detector of the printer can detect the change of the relative position between the print head and the recorded medium and because the printer can execute satisfactory printing by controlling the print head in synchronization with the detected change of relative position even if the travel speed is not fixed, a carriage is not required. Further, the printer can be small-sized, with excellent portability, and can be carried and used outdoors. Finally, because printing can be readily executed in an arbitrary position on a recorded medium, printing can be executed on, for example, a bound thick book and document or a paper with large dimensions on which printing cannot be executed using a prior stationary type printer.

However, the prior printer is carried separately from an external computer, making it inconvenient to carry and use outdoors, for example.

In addition, there is a problem in that a procedure for receiving print data from an external computer is required because data sent from the external computer is received by the printer via a cable or by infrared radiation. When the external computer and the printer are connected via a cable, a dedicated cable is required to be carried together with the external computer. Use of the dedicated cable causes operability to deteriorate when the printer scans. When infrared radiation is used, an error frequently occurs in receiving or sending data because the effective angle of the directivity of an infrared ray is narrow and the effective communication distance is short.

SUMMARY OF THE INVENTION

This invention has as an object to solve the above problems and by providing a scanning printer that can be carried integrally with an external computer. By being connected to the external computer, the scanning printer can receive image information securely from the external computer and has excellent operability during printing.

To achieve this object, a scanning printer is provided with a recording device for forming an image on a recorded medium and a storage device for storing image information for forming the image by the recording device. The scanning printer can be connected to the external computer by a connection interface. A control device receives image information from the external computer and stores it in the storage device when the scanning printer is connected to the external computer via the connection interface. The control device controls the scanning printer so that an image is formed by the recording device when the scanning printer is detached from the external computer.

In another aspect of the invention, the connection interface of the scanning printer may also be constituted according to a Personal Computer Memory Card International Association (PCMCIA) interface standard.

In yet another aspect of the invention, the scanning printer may be attached to or detached from the external computer by inserting the connection interface into or extracting it from a PCMCIA card slot of the external computer.

In yet another aspect of the invention, the scanning printer is provided with a power storage device for supplying power to the recording device, the storage device and the control device. The scanning printer may be also constituted so that power is supplied from the external computer and stored in the power storage device when the connection interface is connected to the external computer.

In yet another aspect of the invention, the recording device is arranged at one end of a body of the scanning printer and the connection interface is arranged at the other end of the body. The body may be also formed so that the body at the one end is thicker than at the other end.

In yet another aspect of the present invention, an ink jet head may be used as the recording device.

As explained above, the scanning printer according to this invention can be connected to the external computer and can be readily carried integrally with the external computer, thus eliminating the inconvenience of carrying a printer separately. Further, the scanning printer may be readily used outdoors. Because image information from the external computer is directly received via the connection interface, the occurrence of errors may be extremely low. Because the scanning printer is not connected to the external computer when printing, its operability is enhanced.

In yet another aspect of the invention, when the connection interface is constituted according to the PCMCIA interface standard, the scanning printer can be easily connected electrically to the external computer thereby reducing problems associated with receiving and sending image information.

In yet another aspect of the invention, because the scanning printer can be attached or detached by inserting the connection interface into or extracting it from the PCMCIA card slot of the external computer, operability in attachment or detachment can be improved.

In yet another aspect of the invention, the power storage device is provided for storing power supplied from the external computer via the connection interface. Because the power required by the scanning printer is supplied from the power source of the external computer, the scanning printer does not require a separate battery charger. This eliminates one additional component to carry. Because the power storage device is charged by the external computer, it can be used separately, making the scanning printer more economical.

In yet another aspect of the invention, the recording device is arranged at one end of the body of the scanning printer and the connection interface is arranged at the other end of the body. The body is formed so that at the one end the body is thicker than that at the other end. This facilitates layout of the recording device and other components.

In yet another aspect of the invention, the recording device uses an ink jet method. Thus, printing is executed without contact with the recorded medium and a satisfactory printing result can be obtained even if the recorded surface is not flat. Because the construction of the recording device when using an inkjet head is simpler to use than a ribbon printer. Thus, the scanning printer can be miniaturized and printing can be more clearly executed.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

Figure 1:
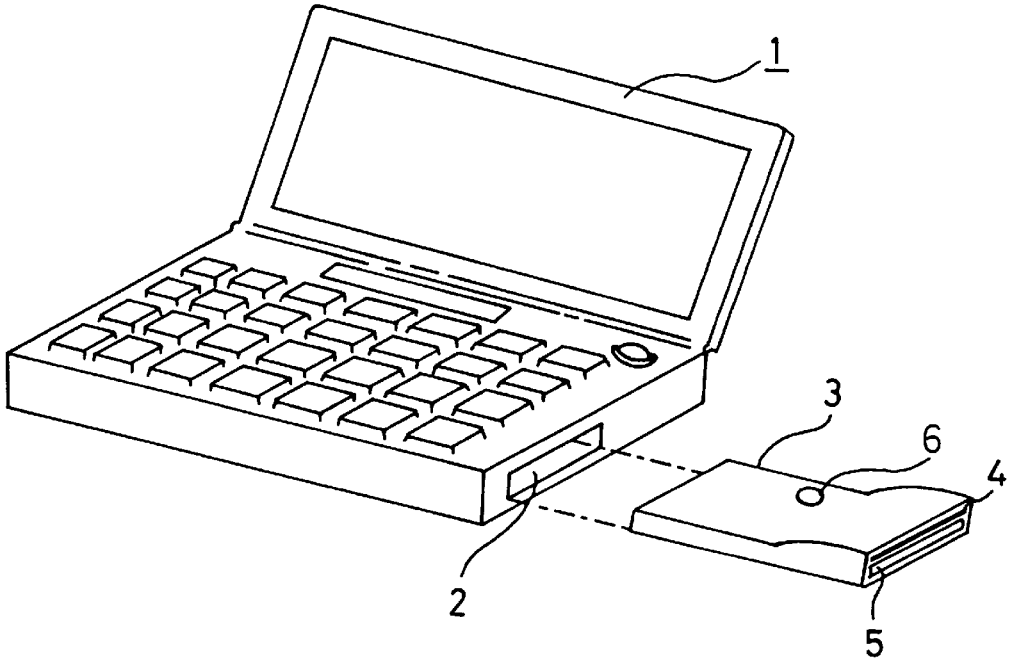
FIG. 1 is a perspective drawing showing the appearance of a scanning printer in one embodiment.

Referring to the drawings, embodiments according to the invention are described below.

FIG. 1 is a perspective view showing the scanning printer 3 and a portable computer 1 as the external computer to which the scanning printer 3 is connected.

The portable computer 1 is provided with a card slot 2 according to the Personal Computer Memory Card International Association (PCMCIA) standard. One personal computer (PC) card according to Type III of the PCMCIA standard can be inserted into the card slot 2. If the PC card conforms to Type II of the PCMCIA standard, two upper and lower PC cards can be housed in the card slot 2. The scanning printer 3 is formed so that it can be inserted into the card slot 2. The scanning printer is electrically connected to the computer 1 via a connector 7 (described later) by inserting the scanning printer 3 into the card slot 2. Image information such as print data is transferred between the computer 1 and the scanning printer 3.

Figure 2:
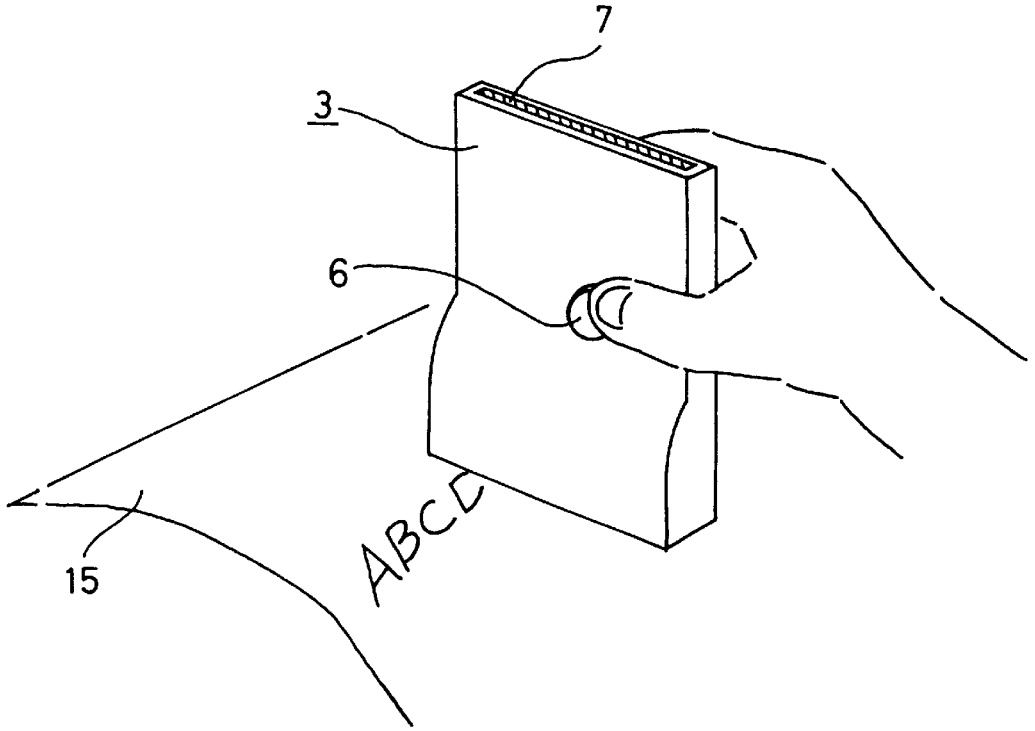
FIG. 2 is an image view showing a situation in which the scanning printer in one embodiment scans and prints.

FIG. 2 shows the scanning printer 3 as it prints on a recording paper 15. The scanning printer 3 prints by an operator holding it by hand in a posture shown in FIG. 2, pressing a printing button 6 and scanning the recording paper 15 as a recording medium.

Figure 3:
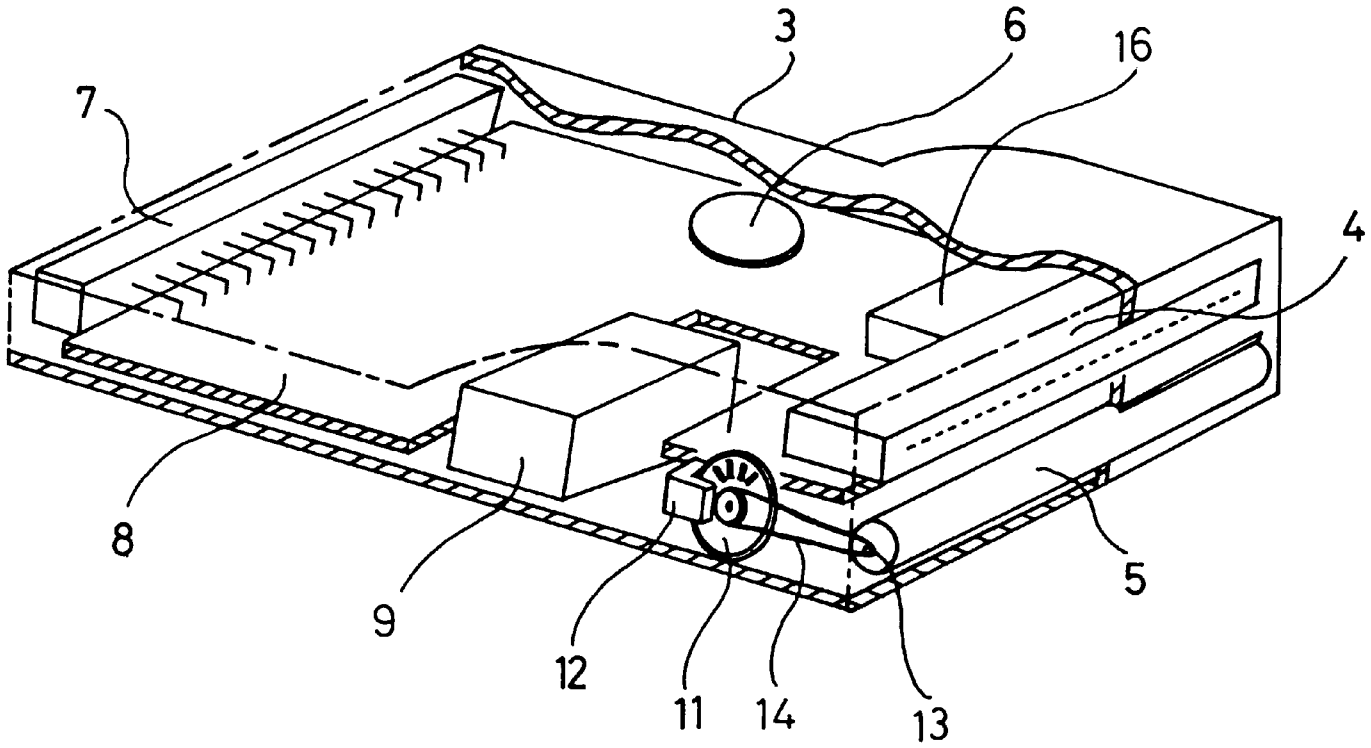
FIG. 3 is a perspective drawing showing the internal components of the scanning printer in the embodiment.

FIG. 3 is a perspective view showing the internal components of the scanning printer 3. An ink jet head 4 as the recording device is arranged at one end of the body of the scanning printer 3. A roller 5 is arranged on the side of the ink jet head 4 so that the roller can be rotated. An ink reservoir 16 for supplying ink to the ink jet head 4 is arranged beside the ink jet head 4. A pulley 13 is arranged on a rotational central shaft of the roller 5 so that the pulley 13 is rotated in accordance with the rotation of the roller 5. A belt 14 is fastened to the pulley 13 and constituted so that the torque of the pulley 13, rotated in accordance with the rotation of the roller 5, is transmitted to an encoder plate 11. A slit is provided at a predetermined interval in the circumference of the encoder plate 11 and constituted so that the rotational speed of the encoder plate 11 is converted to an electric pulse signal by a photointerruptor 12 turned on or off by the rotation of the slit.

A connector 7, functioning as a contact when the scanning printer is inserted into the card slot 2 of the computer 1, is arranged on the side opposite to the ink jet head 4 of the scanning printer 3. The connector 7 is formed according to the PCMCIA standard.

The thickness of the scanning printer 3 on the side having the connector 7 is substantially equal to hat of a PC card according to Type II of the PCMCIA standard. The thickness on the side of the ink jet head 4 is equal to that of a PC card according to Type III of the PCMCIA standard and is the double the thickness of a PC card according to Type II. The opening of the card slot 2 is provided with a height in which two upper and lower PC cards according to Type II can be housed. Thus, the scanning printer 3 from the side of the connector 7 to the side of the ink jet head 4 is completely housed in the portable computer 1.

Because the scanning printer 3 is formed so that the thickness on the side with the ink jet head 4 is thicker than that on the side of the connector 7 as described above, the ink jet head 4 and the roller 5 can be readily arranged.

Inside the scanning printer 3, a control board 8 contains an electrical part for controlling the scanning printer 3. A battery 9 as the power storage device for supplying power of the scanning printer 3 is arranged in the center of the body. The battery 9 may be a chargeable secondary battery and a capacitor.

Figure 4:
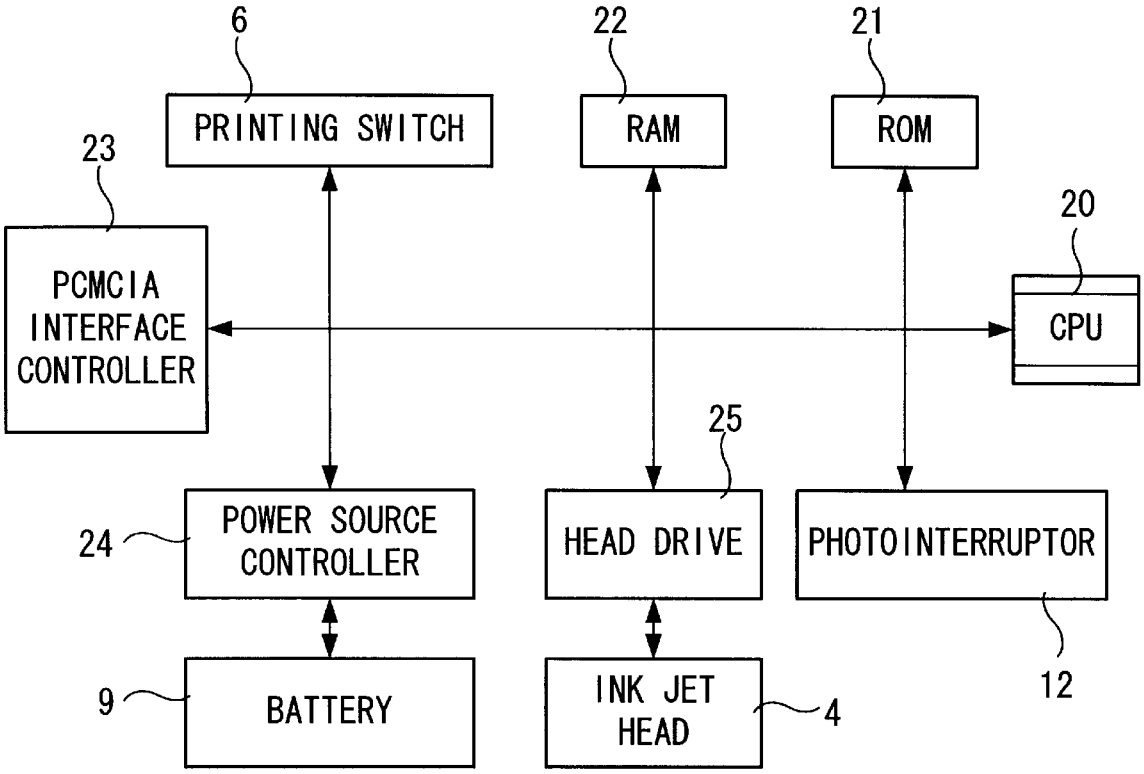
FIG. 4 is a block diagram showing the electric constitution of the scanning printer in the embodiment.

Next, the electric constitution of the scanning printer according to the present invention will be described. FIG. 4 is a block diagram showing the electric constitution of the scanning printer in this embodiment.

In FIG. 4, a ROM 21, which contains a control program for controlling each functional block, and a RAM 22, which stores print data, are connected to a CPU 20. In addition, the photointerruptor 12, a head drive 25 for driving and controlling the ink jet head 4, a power source controller 24 for monitoring the residual capacity of the battery and a PCMCIA interface controller 23 are also connected to the CPU 20.

The PCMCIA interface controller 23 converts the level and the timing of signals that the scanning printer 3 receives from or sends to the computer 1 via the above connector 7 so that they are matched with processing in the scanning printer 3. Therefore, the PCMCIA interface controller 23 and the connector 7 constitute the connection interface according to the invention.

Figure 5:
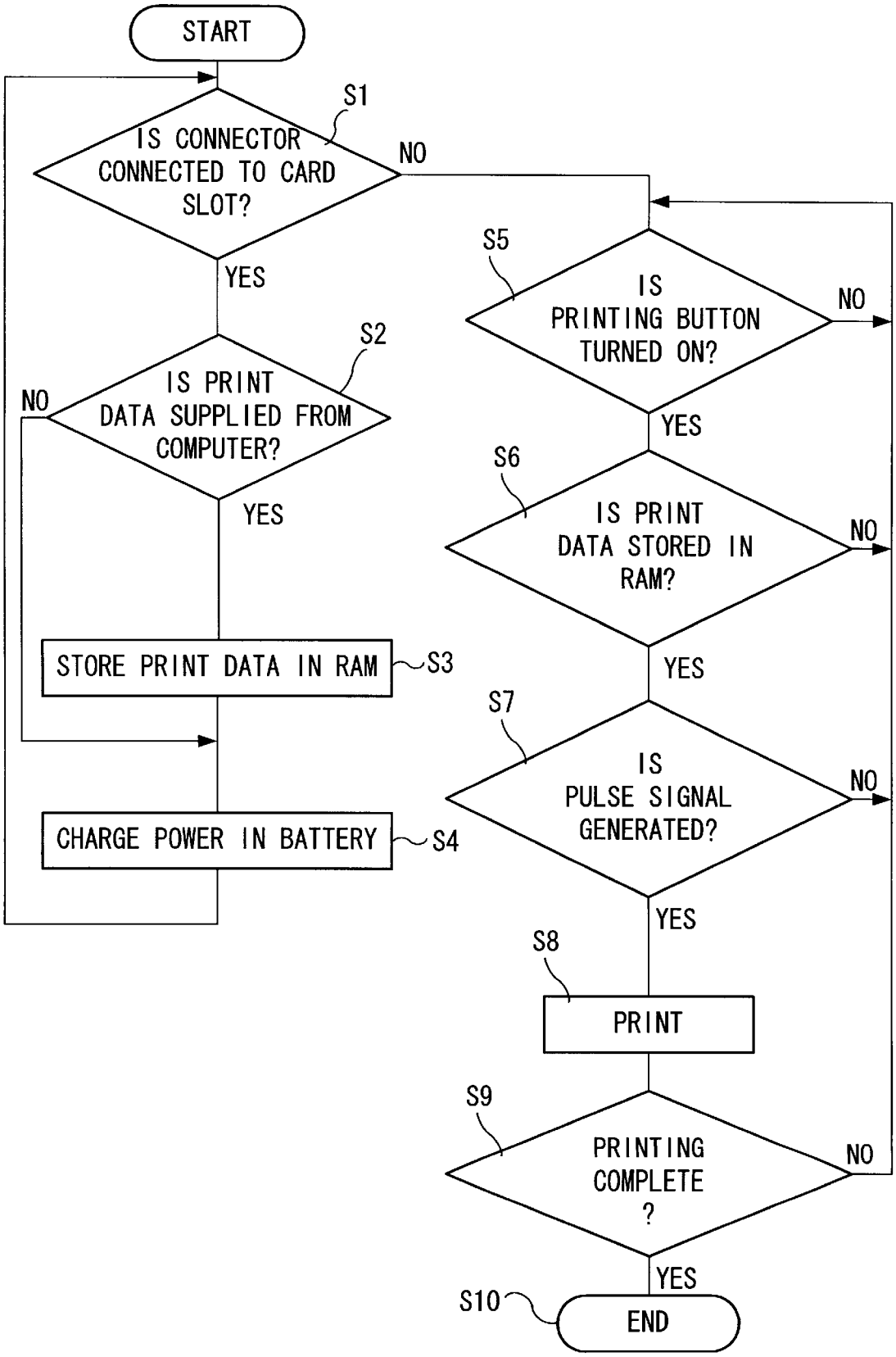
FIG. 5 is a flowchart showing the operation of the scanning printer in the embodiment.

Referring to the flowchart shown in FIG. 5, the operation of the scanning printer 3 in this embodiment will be described below.

The scanning printer 3 is inserted into the card slot 2 of the computer 1 except when the scanning printer 3 prints, that is, the scanning printer 3 is inserted when the computer is carried or data is received. In step S1, the CPU 20 judges whether the connector 7 is connected to the card slot 2. If the connector 7 is connected, the control program proceeds to step S2. Otherwise, the control program jumps to step S5. In S2, the CPU 20 judges whether print data is supplied from the computer 1. If the print data is supplied from the computer 1, the control program proceeds to step S3.

Otherwise, the control program jumps to step S4. In step S3, the print data fetched from the computer 1 via the PCMCIA interface controller 23 is stored in the RAM 22. Because print data is directly fetched via the connector 7, the occurrence of errors can be extremely low, compared with the prior case in which print data is fetched using infrared radiation, for example.

In step S4, the CPU 20 controls the power source controller 24 to receive power from the computer 1 and to charge the battery 9. The control program then returns to step S1.

In printing, an operator extracts this scanning printer 3 from the card slot 2, holds it on the recording paper 15 as shown in FIG. 2 and presses a printing button 6 to start scanning. When the scanning printer 3 scans the recording paper 15, the roller 5 is rotated and the pulse signal is generated from the photointerruptor 12 by the slit on the encoder plate 11, which rotates together with the roller.

In step S5 the CPU 20 judges if the printing button 6 is depressed. If the printing button 6 is depressed, the control program proceeds to step S6. Otherwise, the control program returns to step S5.

In step S6, the CPU judges if print data is stored in the RAM 22. If print data is stored in the RAM 22, the control program proceeds to step S7. Otherwise, the control program returns to step S5.

In step S7, the CPU 20 determines if a pulse signal is generated. If the pulse signal is generated, the control program proceeds to step S8. Otherwise, the control program returns to step S5.

In step S8, the CPU 20 reads the print data stored in the RAM 22 in order and in synchronization with the signal pulse. The CPU 20 then transfers the print data to the head drive 25. The head drive 25 drives the ink jet head 4 to emit ink droplets for printing. Because the scanning printer 3 is not connected to the portable computer 1 during scanning printing, operability can be enhanced, compared with the prior printer connected to a computer via a cable. Following step S8, the program then inquires as to whether the printing is complete in box S9. If not, the program returns to step S5 and inquires as to whether the printing button is turned on. If the printing is complete, the program moves on to box S10 and the program ends.

Because the scanning printer 3 is constituted as described above, it may be readily carried and inserted into the card slot of the personal computer 1, thus eliminating the inconvenience of carrying a printer separately. Further, the scanning printer 3 can be readily used outdoors. The scanning printer 3 can be electrically connected to the computer 1, and print data can be sent and received by inserting the scanning printer 3 into the card slot 2 of the portable computer 1. This eliminates problems encountered in sending and receiving print data by a cable or when using infrared. Finally, the scanning printer 3 can be operated without an external power source and high operability can be realized.

The scanning printer 3 in this embodiment uses the battery 9, which includes the chargeable secondary battery and the capacitor. Power required by the scanning printer 3 is supplied from the power source of the portable computer 1. Therefore, a separate battery charger is not required to be prepared and carried for the scanning printer 3. Further, the battery 9 can be used repeatedly, making the scanning printer economical.

Further, in this embodiment, an example of a portable computer is described as an external computer connected to the scanning printer 3. However, an external computer may be also any word processor and any information processor which can output print data to an external device.

What is claimed is:

1. A scanning printer provided with recording means for forming an image on a recorded medium and storage means for storing image information used by the recording means to form an image on the recorded medium by scanning the recorded medium, said scanning printer comprising:

a body;

connection interface means for electrically connecting the body to an external computer; and control means for controlling image information so that the image information is received from the external computer and stored in said storage means when the connection interface means is connected to said external computer and an image is formed by said recording means when the connection interface means is detached from said external computer, wherein said recording means is arranged at a first end of the body and said connection interface means is arranged at a second end of the body, and wherein the second end of the body is configured to be inserted into a Personal Computer Memory Card International Association card slot of said external computer to electrically connect the scanning printer with the external computer using the connection interface means for transfer of image information from the external computer to the storage means and to provide structural support of the body by the external computer for storage and transport of the scanning printer, said second end of the body being retracted from the card slot to disconnect the connection interface means from the external computer for recording.

2. A scanning printer according to claim 1, wherein said connection interface means conforms to a Personal Computer Memory Card International Association interface standard.

3. A scanning printer according to claim 2, further comprising power storage means for supplying power to said recording means, said storage means and said control means, wherein power is supplied from said external computer and is stored in said power storage means when said connection interface means is connected to said external computer.

4. A scanning printer according to claim 3, wherein said recording means is arranged at one end of a body of the scanning printer and said connection interface means is arranged at the other end of the body, wherein the body is formed so that the body at the one end is thicker than the body at the other end.

5. A scanning printer according to claim 4, wherein said recording means comprises an ink jet printer.

6. A scanning printer for forming an image on a medium connectable to an external computer, which has a Personal Computer Memory Card International Association standard slot that stores the scanning printer, comprising:

a printer housing;

a printing device associated with the printer housing;

a connection interface element that electrically connects the printer housing to the external computer;

a connection interface element controller coupled to the connection interface element;

a main controller that controls the printing device, the main controller being coupled to the connection interface element controller;

a memory connected to the main controller; and a push button on the printer housing that controls the printing device, wherein the image is formed on the medium when the printer housing is scanned over the medium and the push button is activated, wherein, the connection interface element electrically attaches the scanning printer to the external computer to allow data transfer when the printer housing is inserted into the Personal Computer Memory Card International Association standard slot of the external computer, and the connection interface element electrically detaches the scanning printer from the external computer when the printer housing is retracted from the Personal Computer Memory Card International Association standard slot of the external computer to allow the printer housing to be scanned on a medium.

7. The scanning printer according to claim 6, wherein the printing device forms the image based on image information transferred from the external computer to the memory, and wherein the connection interface element controller converts a level and a timing of signals that the main controller receives from or sends to the external computer so that the level and the timing are matched to a given processing in the main controller.

8. The scanning printer according to claim 6, wherein the connection interface element conforms to a Personal Computer Memory Card International Association interface standard.

9. The scanning printer according to claim 8, wherein the printer housing is selectively attached to and detached from the external computer.

10. The scanning printer according to claim 6, wherein the printing device is arranged at a first end of the printer housing and the connection interface element is arranged at a second end of the printer housing, the printer housing being thicker at the first end than at the second end.

11. The scanning printer according to claim 6, further comprising a power storage device that supplies power to the printing device, the memory, the interface connection controller and the main controller, wherein power is supplied from the external computer and is stored in the power storage device when the connection interface is connected to the external computer.

12. The scanning printer according to claim 6, wherein the printing device is an ink jet printer.

13. A method for scanning printing an image on a medium, comprising the steps of:

inserting one end of a scanning printer into a Personal Computer Memory Card International Association standard slot in an external computer thereby electrically connecting the scanning printer to the external computer to form an electrical connection;

transferring image information from the external computer to the scanning printer while the scanning printer is electrically connected to the external computer;

removing the scanning printer from the Personal Computer Memory Card International Association standard slot in the external computer, thereby disconnecting the electrical connection between the scanning printer and the external computer; and scanning the scanning printer over the medium to form an image.

14. The method of claim 13, further comprising transferring power from the external computer to a power supply, which supplies power to the scanning printer, when the scanning printer is attached to the external computer.

15. The method of claim 13, further comprising transferring and converting a timing data and a level data included within the image information to the scanning printer to match a given processing in the scanning printer.

16. A scanning printer, comprising:

a connection interface element that electrically connects the scanning printer to an external computer and conforms to a Personal Computer Memory Card International Association interface standard; and a printer housing supporting the connection interface element and being selectively attachable to and detachable from the external computer, wherein the printer housing is coupled to the external computer by inserting the printer housing into a Personal Computer Memory Card International Association standard slot of the external computer to electrically connect the scanning printer with the external computer using the connection interface element to obtain image data, and the printer housing is retracted from the card slot to disconnect the scanning printer from the external computer to perform printing.

17. The scanning printer according to claim 16, further comprising a printing device, wherein the printing device is arranged at a first end of the printer housing and the connection interface element is arranged at a second end of the printer housing, the printer housing being thicker at the first end containing the printer device than at the second end containing the connection interface.

18. A scanning printer according to claim 16, further comprising a power storage device that stores power supplied from said external computer when said connection interface element is connected to said external computer.

* * * * *